US007559216B2

(12) United States Patent
Imboden et al.

(10) Patent No.: US 7,559,216 B2
(45) **Date of Patent: *Jul. 14, 2009**

(54) THREE-PIECE PANTY GARMENT AND METHODS OF MAKING

(75) Inventors: Walter H. Imboden, Burlington, NC (US); Ronald Wayne Brown, Rural Hall, NC (US)

(73) Assignee: HBI Branded Apparel Enterprises, LLC, Winston-Salem, NC (US)

( * ) Notice: Subject to any disclaimer, the term of this patent is extended or adjusted under 35 U.S.C. 154(b) by 325 days.

This patent is subject to a terminal disclaimer.

(21) Appl. No.: 11/641,477

(22) Filed: Dec. 19, 2006

(65) Prior Publication Data

US 2007/0118958 A1 May 31, 2007

Related U.S. Application Data

(63) Continuation-in-part of application No. 11/376,008, filed on Mar. 15, 2006, now Pat. No. 7,155,940.

(60) Provisional application No. 60/661,845, filed on Mar. 15, 2005.

(51) Int. Cl.
*D04B 1/24* (2006.01)

(52) U.S. Cl. ..... 66/8; 66/177

(58) Field of Classification Search ..... 66/8, 66/176, 177, 169 R, 170, 171, 175
See application file for complete search history.

(56) References Cited

U.S. PATENT DOCUMENTS

| | | | |
|---|---|---|---|
| 3,739,398 | A | 6/1973 | Sarmiento |
| 3,985,004 | A | 10/1976 | Johnson et al. |
| 4,043,156 | A | 8/1977 | Pernick |
| 4,527,403 | A | 7/1985 | Fullbright et al. |
| 4,682,479 | A | 7/1987 | Pernick |
| 4,722,202 | A | 2/1988 | Imboden |
| 5,181,278 | A | 1/1993 | Peleg et al. |
| 6,055,674 | A | 5/2000 | Imboden et al. |
| 6,192,717 | B1 | 2/2001 | Rabinowicz |
| 6,622,312 | B2 | 9/2003 | Rabinowicz |
| 6,968,714 | B2 | 11/2005 | Sangiacomo |
| 2005/0193777 | A1 | 9/2005 | Sangiacomo |

FOREIGN PATENT DOCUMENTS

| | | |
|---|---|---|
| EP | 0516905 | 12/1992 |

*Primary Examiner*—Danny Worrell
(74) *Attorney, Agent, or Firm*—Kilpatrick Stockton LLP

(57) ABSTRACT

A three-piece panty garment can include three panels formed from separate tubular blanks knit on a small-circumference circular knitting machine designed for making pantyhose. As a result, such a panty garment can comprise an unstretched girth that is substantially three times the circumference of a small-circumference circular knitting machine knitting cylinder. Such panty garments and methods of making such panty garments can provide larger size panty garments made on a circular knitting machine designed for making pantyhose.

19 Claims, 7 Drawing Sheets

THREE-PIECE PANTY GARMENT AND METHODS OF MAKING

CROSS-REFERENCE TO RELATED APLICATIONS

This application is a Continuation-in-Part application of, and claims the benefit of, U.S. patent application Ser. No. 11/376,008, filed Mar. 15, 2006 now U.S. Pat. No. 7,155,940, which claims the benefit of U.S. Provisional Patent App. No. 60/661,845, filed Mar. 15, 2005, each of which applications is incorporated by reference herein in its entirety.

COPYRIGHT NOTIFICATION

A portion of the disclosure of this patent document and its attachments contain material which is subject to copyright protection. The copyright owner has no objection to the facsimile reproduction by anyone of the patent document or the patent disclosure, as it appears in the Patent and Trademark Office patent files or records, but otherwise reserves all copyrights whatsoever.

FIELD OF THE INVENTION

The present invention relates to garments and, in particular, to a three-piece panty garment and methods of making such a garment. Embodiments of the present invention are advantageous for providing panty garments in larger sizes.

BACKGROUND OF THE INVENTION

A common method for manufacturing a panty garment involves first knitting a tubular blank. Then, a leg opening is cut out on one side of the tube. The tube is slit lengthwise above and below the leg opening cut-out to provide a flat blank in which the lengthwise left side is a mirror image of the lengthwise right side. The top and bottom of the blank can be folded over onto each other and the sides sewn together to form a panty garment having a waist and two leg openings.

This approach to manufacture of panty garments involves knitting a tubular blank on a circular knitting machine. Circular knitting machines have a knitting cylinder with a particular circumference. A knitted tubular blank can have a width in its relaxed, unstretched state equivalent to one-half the circumference of the knitting cylinder. Two tubular blanks can be used to make a regular size panty garment.

Tubular blanks for making panty garments can be knit on circular knitting machines designed for knitting pantyhose. It may be desirable to manufacture panty garments from circular knitting machines designed for knitting pantyhose because such manufacture permits utilization of knitting machines that are underutilized or are not in use due to decreased demand for pantyhose. Knitting cylinders on circular knitting machines for knitting pantyhose are relatively small, for example, four inches in diameter. Such knitting cylinders are sized to provide a tubular blank that in a stretched condition is capable of covering one leg of a pantyhose garment. As a result, two tubular blanks knit on a circular knitting machine designed for knitting pantyhose may not together have a stretched width large enough to make larger size panty garments.

Thus, there is a need to provide a larger size panty garment made from a circular knitting machine designed for knitting pantyhose. There is also a need for methods for making a larger size panty garment made from a circular knitting machine designed for knitting pantyhose.

SUMMARY OF THE INVENTION

Some embodiments of the present invention can provide a three-piece panty garment. In one such embodiment, the panty garment can comprise a front panel and two back panels. Each panel can be formed from a tubular blank knit on a small-circumference circular knitting machine, slit longitudinally, and opened to a flattened configuration. In an embodiment, the front panel can be formed from a first tubular blank, and the two back panels can be formed from second and third tubular blanks. The panty garment can include a crotch portion integrally knit with the front panel, a waistband at the top of the front and back panels, and two leg openings. A lengthwise seam on each side of the front can extend between the waistband and one of the leg openings to join each side of the front panel and one of the back panels. A lengthwise rear seam can extend between the waistband and the crotch portion to join the two back panels. A rear crotch seam can extend transversely between the leg openings to join the bottoms of the two back panels with the bottom of the front panel.

Such a panty garment formed from at least three tubular blanks can comprise a girth sufficient to form a large size panty. For example, a panty garment of size 10, 12, 14, and larger sizes, can be formed from three or more tubular blanks knit on a circular knitting machine designed for making pantyhose. The final size of a panty garment made from tubular blanks knit on a small circumference circular knitting machine can depend on various factors. For example, in addition to the number of small circumference tubular blanks used to make a panty garment, the loop size knit in the blanks can vary to change the geometry of the blanks. That is, a tubular blank can be knit with large loops to help make a larger size panty garment, or a tubular blank can be knit with smaller loops to help make a smaller size panty garment.

Some embodiments of the present invention can provide methods of making such a three-piece panty garment. For example, one illustrative method comprises knitting at least three tubular blanks on a small-circumference circular knitting machine and making cut-outs for leg openings at predetermined locations about the circumference of the tubular blanks. Markings can be knit into the blanks to identify the predetermined locations at which leg openings can be cut and about which elastic can be sewn. The tubular blanks can each be slit lengthwise to form a front panel from one tubular blank and two back panels from second and third tubular blanks. A lengthwise seam can be sewn on each side of the front between the waistband and one of the leg openings to join each side of the front panel and one of the back panels. Likewise, a lengthwise rear seam can be sewn between the waistband and the crotch portion to join the two back panels. A rear crotch seam can be sewn transversely between the leg openings to join the bottoms of the two back panels with the bottom of the front panel. As a result, a panty garment formed from at least three tubular blanks can comprise a girth sufficient to form a large size panty. For example, a panty garment of size 10, 12, 14, and larger sizes, can be formed from three or more tubular blanks knit on a circular knitting machine designed for making pantyhose.

Features of a three-piece panty garment and methods of making such a garment of the present invention may be accomplished singularly, or in combination, in one or more of the embodiments of the present invention. As will be appreciated by those of ordinary skill in the art, the present invention has wide utility in a number of applications as illustrated by the variety of features and advantages discussed below.

Embodiments of a three-piece panty garment and methods of making such a garment according to the present invention can provide numerous advantages over prior underwear garments and methods of manufacture. For example, some embodiments of the present invention advantageously provide a panty garment made from tubular blanks knit on conventional circular knitting machines designed for making pantyhose. As a result, utilization of otherwise under-utilized or unused knitting machines can improve manufacturing productivity.

Another advantage is that some embodiments of the present invention can provide a large-sized panty garment made from tubular blanks knit on conventional circular knitting machines designed for making pantyhose.

Another advantage is that some embodiments of the present invention can provide a large-sized panty garment having advantageously short, front-placed seams from the waistband to the leg openings.

Another advantage is that some embodiments of the present invention can provide a panty garment having a crotch integrally knit with the front panel. In an embodiment in which the crotch is integrally knit with the front panel, a crotch seam in the front at the junction of the crotch and front panel can be avoided, thus providing increased comfort.

Another advantage is that some embodiments of the present invention can provide a large size panty garment in which cotton or other desirable yam can be knit directly into the crotch. The cotton yams can be knit into the crotch and biased toward the inside of the garment for increased comfort and absorbency.

Another advantage is that some embodiments of the present invention can provide a large size panty garment having a mid-line seam located in the center of the back of the garment. Such mid-line rear seam placement can allow the seam to fit comfortably and to be positioned in the anatomical groove between a wearer's buttocks with a decreased likelihood of showing through clothing.

Another advantage is that some embodiments of the present invention can provide a means for making various sizes of panty garments on the same size knitting machine cylinder by knitting larger or shorter loops to change the amount of yam and stretch in the tubular blank.

As will be realized by those of skill in the art, many different embodiments of a three-piece panty garment and methods of making such a garment according to the present invention are possible. Additional uses, objects, advantages, and novel features of the invention are set forth in the detailed description that follows and will become more apparent to those skilled in the art upon examination of the following or by practice of the invention.

DETAILED DESCRIPTION

In some embodiments of the present invention, a panty garment can comprise a plurality of blanks formed from tubular blanks knit on a small-circumference circular knitting machine. The blanks can be formed by slitting a plurality of circularly knit tubular blanks in half lengthwise. Various numbers of the blanks can be sewn together to form various sized panty garments. FIGS. 1-9 show some of such embodiments.

Figure 1:
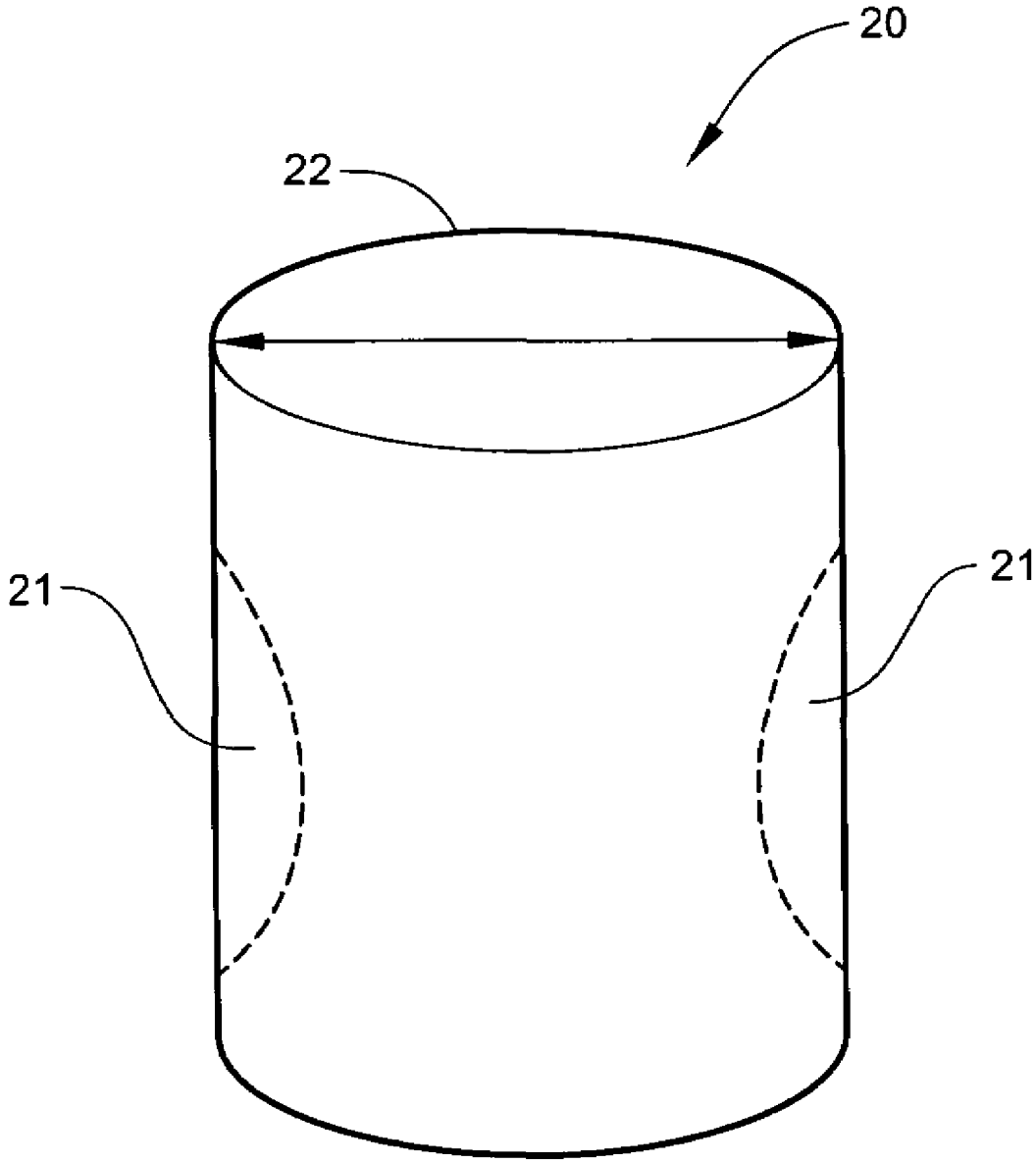
FIG. 1 is a diagrammatic view of a tubular knit blank that may be used in an embodiment of the present invention.

In one illustrative embodiment, as shown in FIGS. 1-5, a three-piece panty garment 10 can include three blanks 11, 12, 13, each formed from a separate tubular blank similar to blank 20 that can be knit on a circular knitting machine. In certain embodiments, the tubular blanks from which the blanks 11, 12, 13 are formed can be knit on a small-circumference circular knitting machine designed for making pantyhose. FIG. 1 illustrates an embodiment of a single tubular knit blank 20 that can have leg opening cut-outs 21 at one or more predetermined locations about the circumference 22 of the blank 20. The tubular blank 20 can be slit lengthwise. Such blanks 20 may be utilized for making larger size panty garments 10 according to certain embodiments of the present invention. The relaxed, or unstretched, girth 23 of the panty garment 10 is defined by the circumference 22 of three tubular blanks 20 after been slit and laid out side-by-side in their relaxed, unstretched state. While the embodiments shown illustrate the panty garment 10 formed from three blanks 11, 12, 13, certain embodiments of panty garments 10 according to the present invention can include two blanks or more than three blanks, depending on the desired size of the finished panty garment 10.

Figure 2:
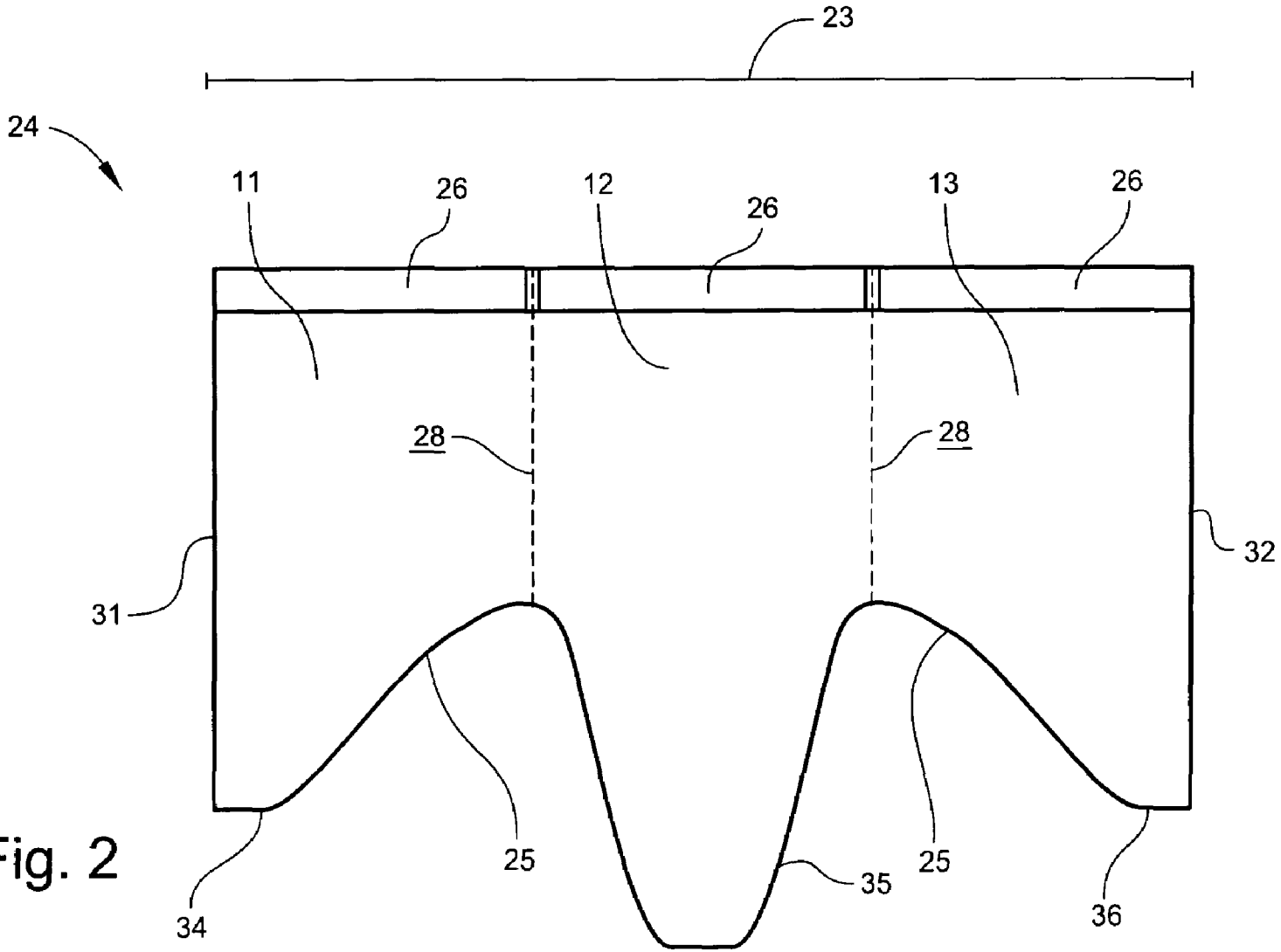
FIG. 2 is a diagrammatic view of three blanks knit on a circular knitting machine laid out for sewing together in an embodiment of a three-piece panty garment of the present invention.
Figure 3:
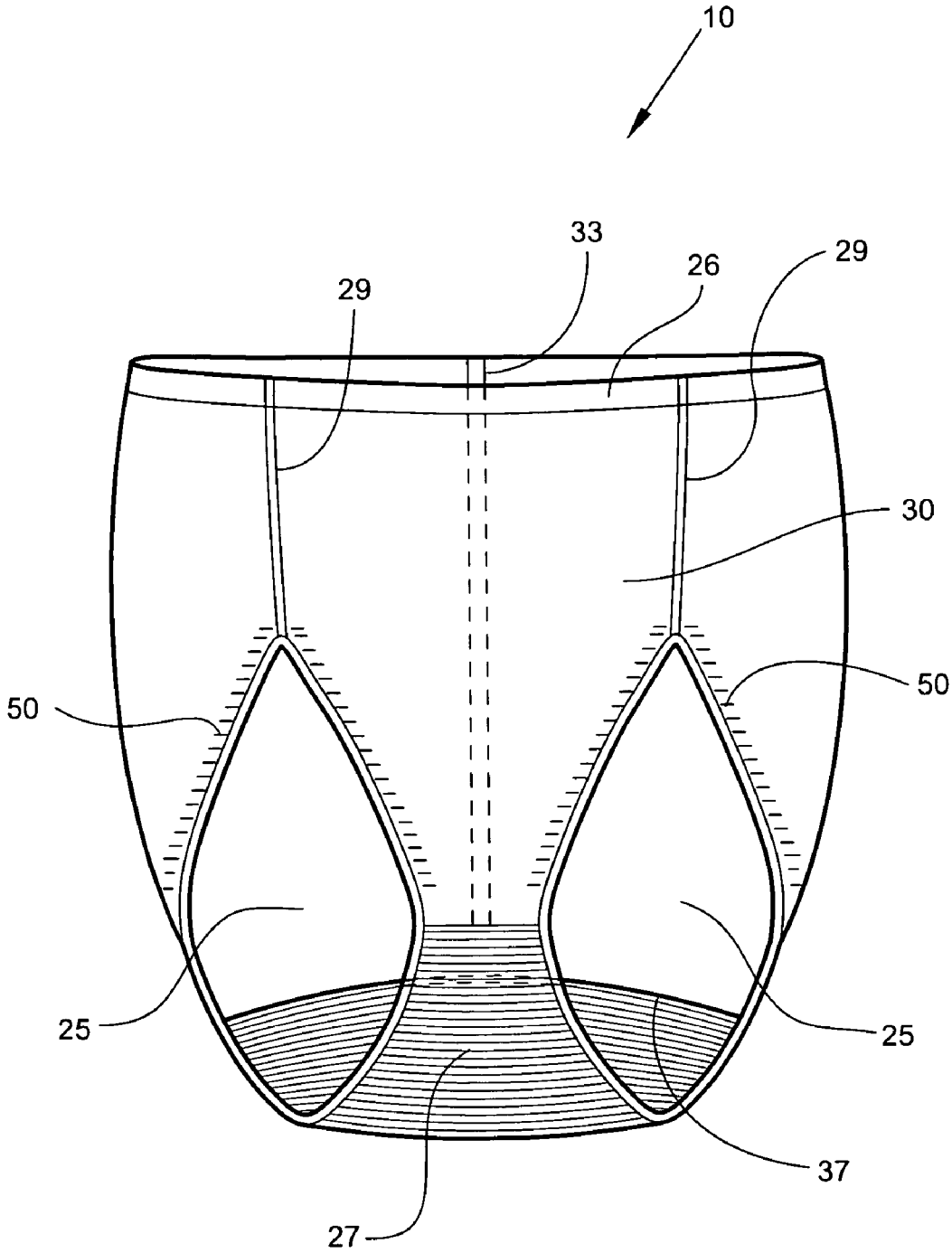
FIG. 3 is a view of a finished three-piece panty garment in an embodiment of the present invention.

In the embodiment shown in FIGS. 2 and 3, the three-piece panty garment 10 can include three separate blanks, or panels, 11, 12, 13 formed from tubular knit blanks that are slit and sewn together to make a larger size panty garment 10. As a result, the relaxed circumference, or girth, 23 of a such panty garment 10 can be three times the relaxed circumference of a circular knitting machine cylinder designed for making pantyhose. Girth of a garment is defined for purposes herein as the effective circumference of the garment in its relaxed state in which yam is not being stretched in a coursewise direction.

As shown in the embodiment in FIGS. 2 and 3, three blanks 11, 12, 13 slit lengthwise from three tubular blanks similar to the tubular blank 20 shown in FIG. 1 can be placed side-by-side to form a panty garment blank 24. Cut-outs 21 can be made specifically for the three-piece panty garment 10 such that the openings 25 from the first blank 11, the second blank 12, and the third blank 13 can be aligned as shown in FIG. 2. In an embodiment, leg opening cut-outs 21 can be made only on one side of the tubular blank 20 so that the side without leg opening cut-outs 21 can form the circumferential waistband 26 when the blanks 11, 12, 13 are aligned side-by-side. The cut-outs 21 can be shaped in any configuration suitable for the opening, for example, the leg opening 25, to be created. The two outer blanks, or back panels, (first blank 11 and third blank 13) as aligned in the panty garment blank 24 can be formed from separate tubular blanks and can be mirror images of each other. The middle blank, or front panel, 12 can be formed from another tubular blank 20 and cut in such a manner as to provide sufficient material for forming a crotch 27. The middle blank 12 may be referred to as the front panel 12. For example, as in the three-piece panty garment 10 shown in FIG. 3, the middle panel 12 can comprise the front portion 30 of the garment 10. The two outer blanks 11, 13 may also be referred to as back panels 11, 13. In the embodiment of the three-piece panty garment 10 shown in FIG. 3, the two outer panels 11, 13 form the back portion of the garment 10. The back panels 11, 13 can also form a small part of the front portion 30 of the garment 10.

Overlapping edges 28, or sides, of the first blank 11 and the second blank 12 can be sewn together along the dotted line as shown in FIG. 2 to form a front seam 29 extending from the waistband 26 to the leg opening 25. Overlapping edges 28, or sides, of the second blank 12 and the third blank 13 can be sewn together along the opposite side dotted line to form another front seam 29 from the waistband 26 to the leg opening 25. Leg openings 25 may often be skewed toward the front 30 of a panty garment 10 due to the desire for a greater amount of fabric on the back than on the front 30 of the garment 10 for purposes of fashion and comfort. In an embodiment, the front seams 29 can extend from the waistband 26 to the topmost portion of the arch of the leg openings 25 on either side of the front portion 30 of the panty garment 10. As a result, the two front seams 29 are thus desirably located so as to be the shortest possible length.

A first side 31 of the panty garment blank 24 can be moved to overlap a second side 32 of the panty garment blank 24, and the overlapping first and second sides 31, 32 can then be sewn together to form a lengthwise rear seam 33 extending downward from the waistband 26. To form the crotch 27 of the panty garment 10, a bottom edge 34 of the first blank 11 and a bottom edge 36 of the third blank 13 can each be overlapped with a portion of a bottom edge 35 of the second blank 12. The overlapped bottom edges 34, 36 of the first and third blanks 11, 13 with the bottom edge 35 of the second blank 12 can then be sewn together to form the rear crotch seam 37. The moving together of the bottom edges 34, 35, 36 of the three blanks 11, 12, 13 and sewing the overlapping edges thereof as described can also complete formation of the leg openings 25 of the panty garment 10. The rear crotch seam 37, as shown in FIG. 3, extends transversely from one leg opening 25 to the other leg opening 25 across the back of the panty garment 10. Accordingly, an embodiment of the present invention can provide a three-piece panty garment 10 including three blanks 11, 12, 13 of tubular blanks knit on a small-circumference circular knitting machine designed for making pantyhose.

Figure 4:
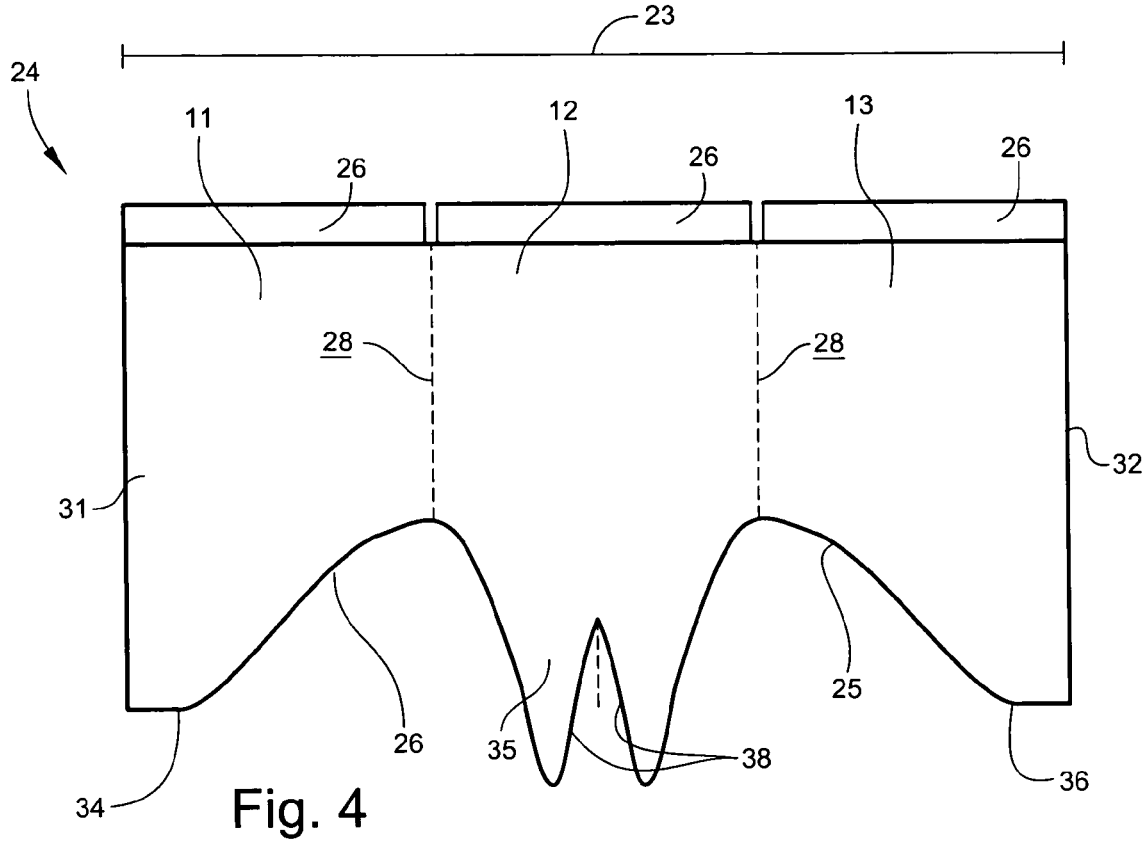
FIG. 4 is a diagrammatic view of three blanks knit on a circular knitting machine, the middle blank having a Y-seam, laid out for sewing together in another embodiment of a three-piece panty garment of the present invention.
Figure 5:
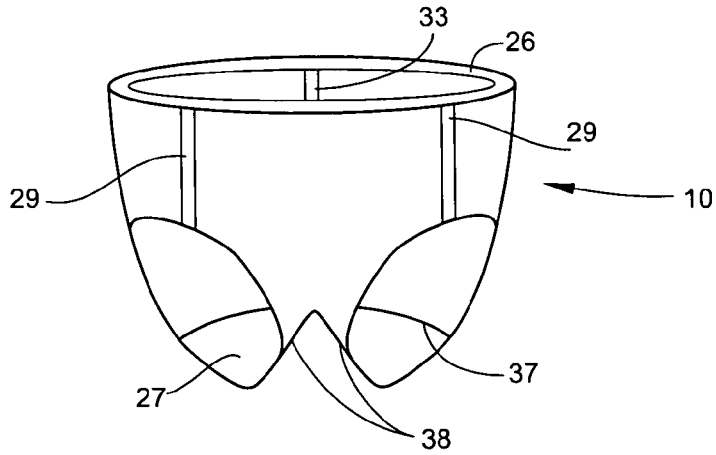
FIG. 5 is a view of an embodiment of a finished three-piece panty garment having a Y-seam formed from the three blanks shown in FIG. 4.

FIGS. 4 and 5 show another embodiment of a three-piece panty garment 10 according to the present invention. As in the embodiment shown in FIGS. 2 and 3, three tubular blanks 11, 12, 13 slit lengthwise from two tubular blanks similar to the tubular blank 20 shown in FIG. 1 can be placed side-by-side. Cut-outs 21 can be made specifically for a three-piece panty garment 10 such that the leg openings 25 from the first blank 11, the second blank 12, and the third blank 13 can be aligned as shown in FIG. 4. In an embodiment, leg opening cut-outs 21 can be made only on one side of the tubular blank 20 so that the side without leg opening cut-outs 21 can form the circumferential waistband 26 when the blanks 11, 12, 13 are aligned side-by-side. The cut-outs 21 can be shaped in any configuration suitable for the opening to be created, for example, a low-rise or a high-rise leg opening 25. The two outer blanks, or back panels, (first blank 11 and third blank 13) as aligned in the panty garment blank 24 can be formed from separate tubular blanks and can be mirror images of each other. The middle blank, or front panel, 12 can be formed from another tubular blank 20 and cut in such a manner as to provide sufficient material for forming the crotch 27. As shown in FIG. 4, the middle blank, or panel, 12 can comprise the front portion 30 of the garment 10. The two outer blanks, or panels, 11, 13 can form the back portion of the garment 10. The back panels 11, 13 can also form a small part of the front portion 30 of the garment 10.

Overlapping edges 28, or sides, of the first blank 11 and the second blank 12 can be sewn together along the dotted line as shown in FIG. 4 to form a front seam 29 extending from the waistband 26 to the leg opening 25. Overlapping edges 28, or sides, of the second blank 12 and the third blank 13 can be sewn together along the opposite side dotted line to form another front seam 29 from the waistband 26 to the leg opening 25. In an embodiment, the front seams 29 can extend from the waistband 26 to the topmost portion of the arch of the leg openings 25 on either side of the front portion 30 of the panty garment 10. As a result, the two front seams 29 are thus desirably located so as to be the shortest possible length.

The first side 31 of the panty garment blank 24 can be moved to overlap the second side 32 of the panty garment blank 24, and the overlapping first and second sides 31, 32 can then be sewn together to form the lengthwise rear seam 33 extending downward from the waistband 26. To form the crotch 27 of the panty garment 10, the bottom edge 34 of the first blank 11 and the bottom edge 36 of the third blank 13 can each be overlapped with a portion of the bottom edge 35 of the second blank 12. The overlapped bottom edges 34, 36 of the first and third blanks 11, 13 with the bottom edge 35 of the second blank 12 can then be sewn together to form the rear crotch seam 37. The moving together of the bottom edges 34, 35, 36 of the three blanks 11, 12, 13 and sewing the overlapping edges thereof as described can also complete formation of the leg openings 25 of the panty garment 10. The rear crotch seam 37, as shown in FIG. 5, extends transversely from one leg opening 25 to the other leg opening 25 across the back of the panty garment 10.

In the embodiment shown in FIGS. 4 and 5, the crotch 27 includes a Y-seam 38 as may be used, for example, in conventional pantyhose. The Y-seam 38 can be formed by slitting lengthwise the bottom portion of the second, or front, blank panel 12 for a predetermined length and sewing together the edges of the lengthwise slit. Each edge of the bottom portion of the front blank panel 12 thus formed can then be sewn along the bottom edge 34, 36 of the adjacent blank 11, 13. In this manner, a Y-shaped seam 38 can be formed in the crotch 27 of an embodiment of the three-piece panty garment 10 according to the present invention. Thus, another embodiment of the present invention can provide a three-piece panty garment 10 including three blanks 11, 12, 13 of tubular blanks knit on a small-circumference circular knitting machine designed for making pantyhose.

In some embodiments of the present invention, the same size knitting cylinder of a circular knitting machine (not shown) can be used to make tubular blanks useful for manufacturing various sizes of panty garments 10. A small-circumference circular knitting machine can have a knitting cylinder of, for example, four inches or eight inches. Such knitting machines can have a single cylinder, double cylinder, cylinder and dial, or other configuration for producing a tubular blank. Tubular blanks useful for forming blanks 11, 12, 13 for various size panty garments 10 can be modified on the same knitting cylinder by changing the stitch, or yarn loop, length as it is knit into the blank. As an example, the three blank panels 11, 12, 13 formed from tubular blanks knit on a four-inch knitting cylinder and that are slit lengthwise and laid side-by-side can comprise the girth 23 equivalent to three circumferences of the knitting cylinder. In certain embodiments, the three blank panels 11, 12, 13 having such dimensions can be sewn together to provide panty sizes 10, 12, and 14, or larger. In other embodiments, the three blank panels 11, 12, 13 having such dimensions can be sewn together to provide smaller panty sizes. Panty size 10 can accommodate a hip girth of 48 inches. Panty size 12 can accommodate a hip girth of 56 inches. Panty size 14 can accommodate a hip girth of 64 inches.

Figure 8:
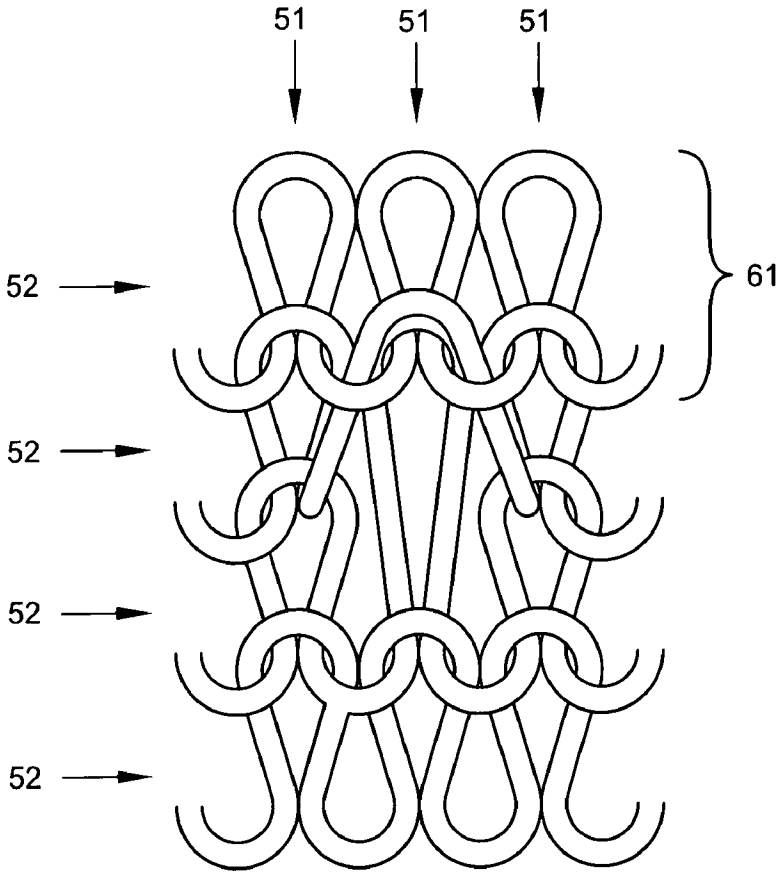
FIG. 8 is a diagrammatic view of a tuck stitch useful as a run guard in an embodiment of the present invention.

In an illustrative embodiment, three blanks 11, 12, 13 formed from tubular blanks knit with a predetermined stitch loop length 61 (as shown in FIG. 8)on a four-inch circular knitting machine can be slit lengthwise and sewn together to form a panty garment 10, for example, a size 10 panty garment 10. To make a size 12 panty garment 10, three blanks 11, 12, 13 can be formed from tubular blanks made on the same four-inch circular knitting machine knitting cylinder as the tubular blanks from which the three blanks 11, 12, 13 for the size 10 panty garment 10 are knit. However, for the three blanks 11, 12, 13 to be used for a size 12 panty garment 10, the tubular blanks can be knit with a larger stitch loop length 61 than for the tubular blanks from which the three blanks 11, 12, 13 to be used for a size 10 panty garment 10. Likewise, to make a size 14 panty garment 10, three blanks 11, 1,2, 13 can be formed from tubular blanks knit on the same four-inch circular knitting machine knitting cylinder as the tubular blanks from which the three blanks 11, 12, 13 for the size 10 and 12 panty garments 10 are knit. For the three blanks 11, 12, 13 to be used for a size 14 panty garment 10, the tubular blanks can be knit with an even longer stitch loop length 61 than the stitch loop length 61 used in the tubular blanks from which the three blanks 11, 12, 13 to be used for a size 12 panty garment 10 are knit.

In some embodiments, the three blanks 11, 12, 13 formed from tubular blanks knit on the same small-circumference knitting cylinder as the tubular blanks for larger size (size 10, 12, 14, and larger) panty garments 10 can be utilized to make panty garments 10 smaller than size 10. In such embodiments, the stitch loop length 61 can be increased as the tubular blanks are knit so that the resulting fabric has a tighter knit structure relative to the tubular blanks from which the three blanks 11, 12, 13 for a size 10 panty garment 10 are formed. In addition to having a smaller size, such a panty garment 10 having a tighter knit structure may also exhibit greater durability.

Some embodiments of the panty garment 10 of the present invention manufactured from multiple tubular blanks knit on a small-circumference circular knitting machine designed for making pantyhose can include desired patterning. Such patterning can be programmed in the knitting machine.

Panty garments 10 of the present invention can include a turned waistband 26, as shown in FIGS. 2 and 4. The turned waistband 26 can be sewn after the first, second, and third blanks 11, 12, 13 are sewn together to form the three-piece panty garment 10. Alternatively, a separate waistband 26, for example, a waistband 26 comprising elastic yarn, can be sewn onto the top of the three-piece panty garment 10 after it is formed. Some embodiments of panty garments 10 of the present invention can include leg openings 25 having a thin band of elastic sewn around the edges of the leg openings 25. In other embodiments, other conventional leg bands can be applied to the edges of the leg openings 25.

In some embodiments, the crotch portion 27 of the blanks 11, 12, 13 may be knit with the same yarn as the remainder, or body portion, of the panty garment 10. For example, the crotch portion 27 may be knit with nylon, or with cotton as shown in FIG. 3. Cotton yarns can be knit into the crotch portion 27 and biased toward the inside of the garment 10 for increased comfort and absorbency. In an embodiment, the crotch portion 27 may be knit with the same or a different stitch as in the body portion. For example, alternate courses of the crotch portion 27 may float across several loops, and the floats may be in line with one another to form a ribbed look. Alternatively, the courses may be uniformly staggered in a zig-zag pattern to produce a waffle effect, or the floats may be in a random pattern, depending upon the look desired in the crotch portion 27.

Figure 6:
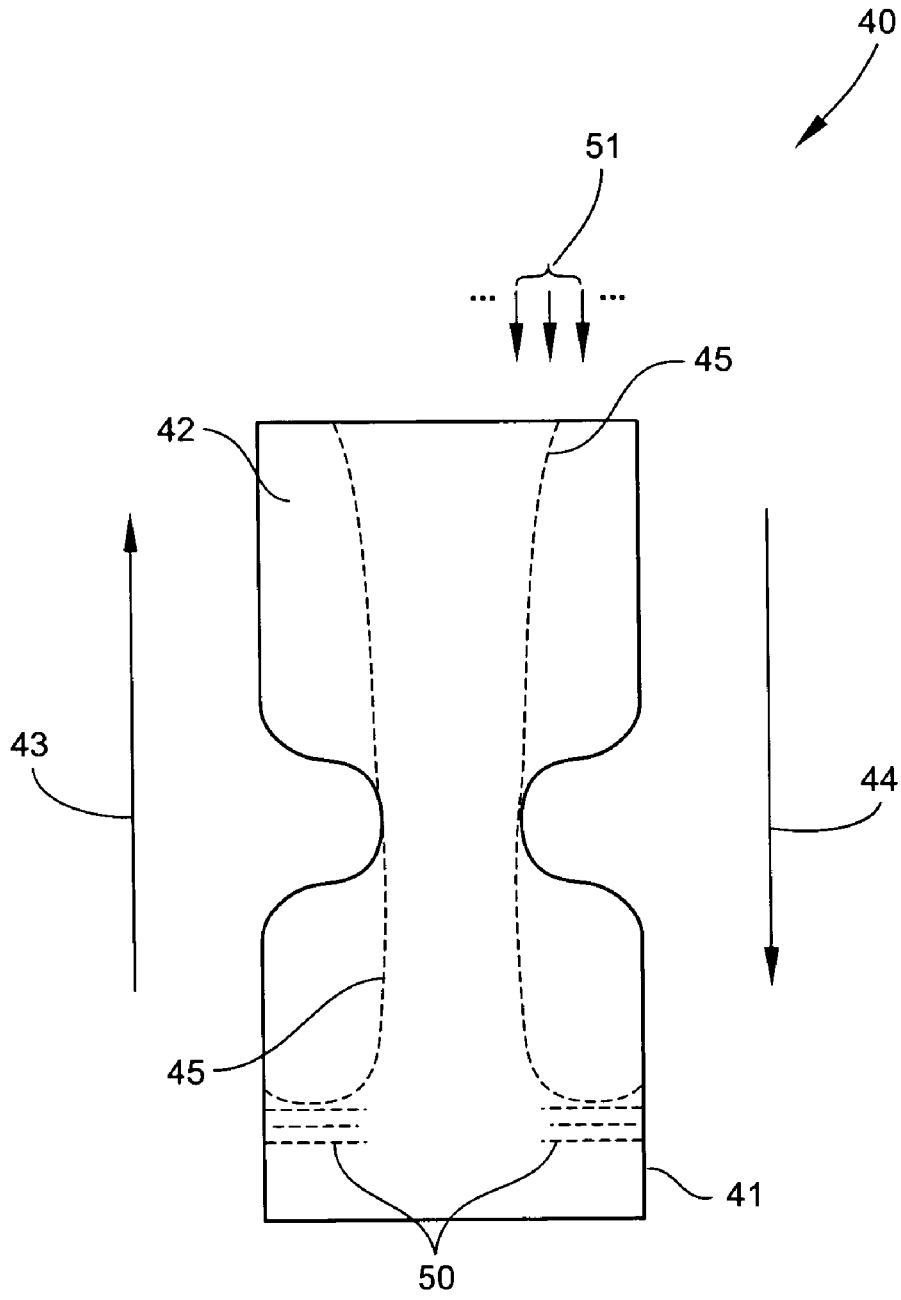
FIG. 6 is a diagrammatic view of a one-piece underwear garment blank in an embodiment of the present invention.

Some embodiments of the three-piece panty garment 10 of the present invention can include a mechanism for preventing runs, as shown in FIGS. 3 and 6. As shown in the embodiment of the slit and laid open blank 40 in FIG. 6, in manufacture of some types of panty garments 10, the area in the cut-out 21 for leg openings 25 in the back portions 42 of the garment 10 is less than the area in the cut-out 21 for leg openings 25 in the front portions 41 of the garment 10. Such a design leaves more fabric in the back portion 42 than in the front portion 41 for greater coverage of the buttocks region. This design is due to the human anatomy in the front lower torso and buttocks regions, particularly the female anatomy in these regions, and because of underwear fashions. When the leg portions are cut out of the front 41 of a panty garment 10, either manually by an operator or in an automated process, cuts are made generally across wales 51. Cutting across wales 51 can create loose ends of yarn, which can then create a "run" in the finished panty garment 10.

After front and back leg openings 25 are cut out, a welt can be sewn around the cut edges of the leg openings 25. When a welt is sewn across wales 51 around the leg openings 25, particularly in the front portion 41 leg openings 25, there is a risk that loose yarn ends can run during the sewing process. Some embodiments of the present invention can provide mechanisms and methods for reducing and preventing such runs in knitted panty garments 10.

In some embodiments of the panty garment 10, knitting can proceed from the front 41 to the back 42 in a front-to-back 43 knitting process. In other embodiments, knitting can proceed in a back-to-front 44 knitting process, in which the back portion 42 (or bottom) of the panty garment 10 is knit first followed by knitting the front portion 41 (or top) of the garment 10. Sewing marks 45 can be knit into the front 41 and back 42 portions of a garment for indicating the locations for cutting out leg opening cut-outs 21 (and for sewing welts along edges of the cut-outs 21). Sewing marks 45 can be incorporated into knitting by programming stitch and/or yam changes at pre-determined locations. In the underwear garment blank 41 shown in FIG. 6, less fabric is cut from the back portion 42 than the front portion 41 for leg openings. The angle at which the leg opening cut-outs 21 in the back portion 42 are cut is approximately parallel to the wales 51. As a consequence, fewer wales 51 are cut across when making leg openings cut-outs 21 in the back portion 42, thereby reducing, or preventing, the possibility of runs in the back portion 42 of the underwear garment 10. In addition, cutting across a minimum number of wales 51 provides a stronger seam along the edge of the leg opening cut-out 21.

Figure 7:
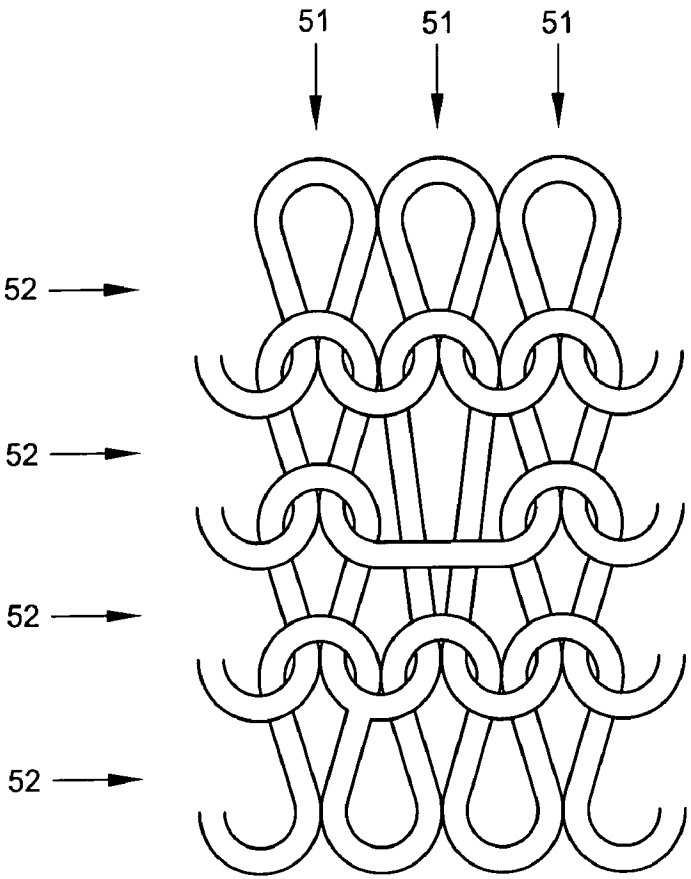
FIG. 7 is a diagrammatic view of a float stitch useful as a run guard in an embodiment of the present invention.

In some embodiments of the present invention, run-prevention stitches 50 can be placed in desired courses of the knitted panty garment 10. For example, in the embodiment shown in FIGS. 3 and 6, run-prevention stitches 50 can be knit, for example, adjacent to the sewing marks 45, where the front leg openings 25 are to be cut out. Run-prevention stitches 50 can include, for example, float stitches (as shown in FIG. 7) and/or tuck stitches (as shown in FIG. 8). A "float stitch," or "miss" stitch, is defined as a stitch formed when a knitting needle holds an old loop and does not receive new yam, thereby connecting two loops of the same course that are not in adjacent wales. A "tuck stitch" (FIG. 8) is defined as a knitting stitch that produces tuck or openwork effects by having certain needles hold more than one stitch at a time. A tuck stitch (FIG. 8) can be produced by raising the latch of a knitting needle far enough to receive a new yarn below the hook but without the old yarn loop(s) sliding below the latch, such that when the needle recedes, both new and old loops are retained. In some embodiments of the present invention, float stitches and/or tuck stitches can prevent runs in the direction of knitting. In the embodiment shown in FIG. 3, each of the three tubular blanks from which the blanks 11, 12, 13 are formed can be knit in the same direction, for example, from the bottom to the top. Accordingly, in a panty garment knit from back to front, run-prevention stitches 50 placed downstream of the front leg opening cut-out areas 25 can prevent runs in the direction of knitting, that is, in the front portion 30 of the panty garment 10.

Figure 9:
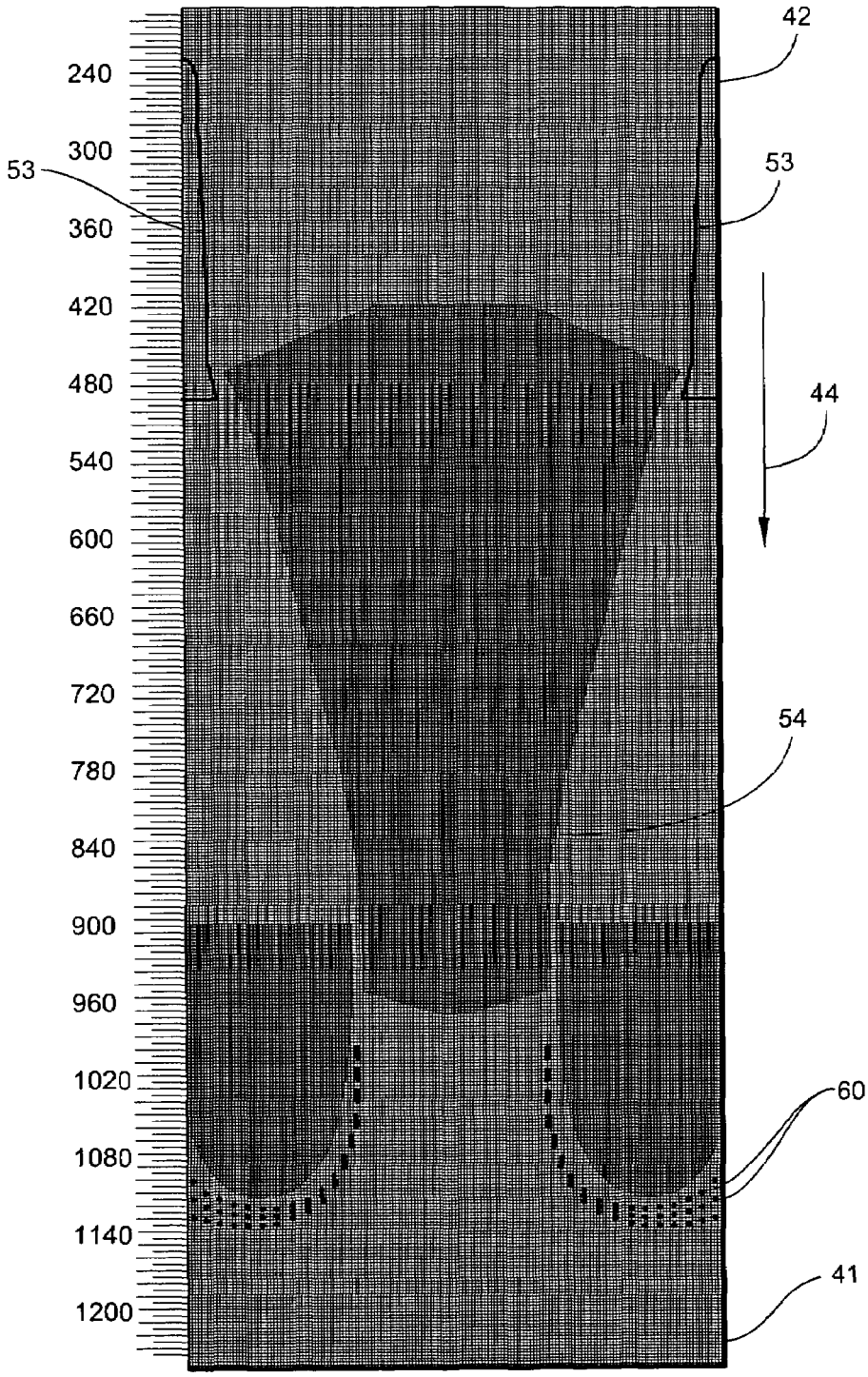
FIG. 9 is a diagrammatic view of a knit pattern for an underwear garment showing placement of run-prevention stitches adjacent front leg cut-out areas in the direction of knitting in an embodiment of the present invention.

FIG. 9 illustrates a knitting pattern for a panty garment blank in which the blank is knit in a back-to-front 44 knitting process. The back leg cut-out lines 53 (which represent the back leg opening sew lines 45) are nearly parallel to the wales 51 such that a minimum number of wales 51, or no wales 51, are cut across when the back leg openings 25 are cut. As a result, loose ends and runs are prevented along the back leg openings 25. In automated panty manufacturing operations, cutting leg openings 25 and sewing seams and/or bands around the edges of the leg openings can be a combined and nearly simultaneous step. The knitting pattern in FIG. 9 shows that run-prevention stitches 50 can be knit adjacent to the sewing marks 45 along the cut-out lines 54 where the front leg opening cut-outs are to be made. Run-prevention stitches 50 placed adjacent to front leg opening cut-out 54 areas can prevent runs, in the direction of knitting 44, that is, up the front 30 of the panty garment 10.

Some embodiments of a method for preventing runs in panty garments 10 of the present invention can be utilized on conventional hosiery knitting machines, for example, a 400-needle, Lonati electronic circular knitting machine. In some embodiments, any knitting machine having a needle selection capability sufficient to knit run prevention stitches at desired locations may be used.

In some embodiments of the present invention, the three-piece panty garment 10 can include various mechanisms for preventing ravels. For example, in one such embodiment, the panty garment 10 can include a mechanism for preventing garment raveling by timing of yarn removal from a knitted finish end.

In an illustrative embodiment, a ravel prevention mechanism (not shown) comprising timing of yarn removal from a knitted finish end can include the following: In a four-feed circular knitting machine, full revolutions of the knitting cylinder can be made to knit full courses of jersey stitches on all four feeds. Knitting of three feeds can be discontinued at a designated point near the finish end of the tubular blank. The remaining feed is programmed to knit a 1×1 positive float stitch (as shown in FIG. 7), in which a jersey stitch is knit, followed by a float stitch, which is followed by a jersey stitch, and then another float stitch, in a repeating pattern. Thus, all feeds but one can be de-selected at a designated point near the finish end of the tubular blank such that a single feed is used to knit a ravel prevention float stitch pattern 60.

In some embodiments, a ravel prevention positive float stitch pattern 60 can be a 1×1, 2×2, 3×1, or other selection float stitch to promote rolling of the fabric finish end. The positive float stitch pattern 60 can be knit for at least six revolutions of the knitting cylinder. In panty garments 10 knit by such a pattern 60, the loops of the float stitches can be pulled toward the previous course. Jersey stitches can then be knit for a predetermined number of courses. At least two full courses of jersey stitches can be knit. Next, all needles can be pulled up for at least two full revolutions, so that two full courses of jersey stitches are knit. In this manner, the last jersey knit course can be connected by the float stitches to previous jersey courses. Then, all needles can be gradually dropped below the yarn level such that the yarn is pulled out of all needles. The knitting cylinder can be rotated for one full revolution with all needles down (below the knitting platform and sinkers) and thus with no knitting occurring. Finally, all needles can be returned to the up position. The needles can be maintained in the up position for a full revolution but without taking yarn in order to shed, or release, the yarn from the finish end of the panty garment blank so that the panty garment blank can exit the knitting machine cleanly.

In conventional knitting techniques, all needles may not be taken down below the knitting platform, sinkers, and yarn level for a full revolution in the next-to-last revolution, but rather the needles continue to pull yarn. As such, more "run-off" yarn "tails" are created, and the risk of raveling increases. In attempt to compensate for this increased risk for raveling thus created, operators often make the stitches in the last revolution tighter. In larger panty garments, it is often desirable to maintain the same degree of tightness, or compression, in the last course of knitting as in the remainder of courses in the garment. In some embodiments of the present invention in which all needles are dropped below the yarn and no knitting occurs for at least a full revolution, the number of "run-off" yarn "tails" can be reduced. Therefore, such tightening in the last course may not be necessary. Accordingly, embodiments of the present invention advantageously allow knitting of panty garment tubular blanks without tightening the last knitted course, while maintaining an increased resistance to raveling on the garment finish end.

In other embodiments, selecting a stitch that facilitates rolling of the garment edge can be utilized to prevent raveling. These and other mechanisms can be utilized to prevent yarn raveling in various embodiments of the present invention. In some embodiments, the direction of knitting the tubular blanks used to make the three-piece panty garment 10 can be in a direction toward the portion of the blanks that comprise the waistband 26 of the garment 10. In such embodiments, ravel prevention mechanism(s) can provide an improved finish quality and durability in the panty garment 10.

Embodiments of the present invention can include methods of making a three-piece panty garment 10. For example, one illustrative method comprises knitting at least three tubular blanks similar to tubular blank 20 on a small-circumference circular knitting machine and making cut-outs 21 for leg openings at predetermined locations about the circumference of the tubular blanks. The tubular blanks can be slit lengthwise to form a front panel 12 from a first tubular blank and two back panels 11, 13 from a second and a third tubular blank. Lengthwise front seams 29 extending between a waistband 26 and one of the leg openings 25 can be sewn to join each side 28 of the front panel 12 and one of the back panels 11, 13. Likewise, a lengthwise rear seam 33 extending between the waistband 26 and a crotch portion 27 can be sewn to join the two back panels 11, 13. A transverse rear crotch seam 37 extending between the leg openings 25 can be sewn to join the bottoms 34, 36 of the two back panels 11, 13 with the bottom 35 of the front panel 12. In this way, a panty garment 10 having larger sizes, for example, size 10, 12, 14, and larger, can be made from tubular blanks knit on a small-circumference circular knitting machine designed for making pantyhose. Such a panty garment 10 formed from three tubular blanks 11, 12, 13 can comprise a girth 23 substantially equivalent to three times the circumference 22 of the circular knitting machine knitting cylinder.

In certain embodiments of a method, various sizes of the panty garment 10 can be made on the same circular knitting machine by increasing or decreasing the stitch loop length 61 in the tubular blanks. A larger size panty garment 10 can be made by increasing the loop length 61 in the tubular blanks, and a smaller size panty garment 10 can be made by decreasing the loop length 61 in the tubular blanks.

In another embodiment of a method, the bottom 35 of the front panel 12 can be slit lengthwise for a predetermined length to provide a Y-shaped crotch 38. The slit can be sewn along the crotch 38 to provide a panty garment crotch 38 configured similar to a crotch in conventional pantyhose.

In another embodiment of a method, the panty garment tubular blank 20 can be knit in a direction from the bottom 34, 35, 36 to the top, or from back 42 to front 41. Leg opening cut-outs 21 can be made at an angle across wales 51. By knitting run prevention stitches 50 in predetermined courses downstream from the cut-outs 21, runs downstream from the cut-outs 21 can be prevented. Such run prevention stitches 50 may comprise float stitches and/or tuck stitches.

Although the present invention has been described with reference to particular embodiments, it should be recognized that these embodiments are merely illustrative of the principles of the present invention. Those of ordinary skill in the art will appreciate that a three-piece panty garment and method of the present invention may be constructed and implemented in other ways and embodiments. Accordingly, the description herein should not be read as limiting the present invention, as other embodiments also fall within the scope of the present invention.

What is claimed is:

1. A panty garment, comprising:

a front panel and two back panels, each panel having a top and a bottom, formed from a separate tubular blank knit on a small-circumference circular knitting machine, and slit lengthwise;

a crotch portion integrally knit with the front panel;

a waistband at the top of the front and back panels;

two leg openings;

a lengthwise front seam joining each side of the front panel and one of the back panels and extending between the waistband and one of the leg openings;

a lengthwise rear seam joining the two back panels and extending between the waistband and the crotch portion; and a rear crotch seam joining the bottoms of the two back panels with the bottom of the front panel and extending transversely between the leg openings.

2. The panty garment of claim 1, the circular knitting machine comprising a knitting cylinder having a circumference, and wherein the garment comprises an unstretched girth substantially three times the circumference of the knitting cylinder.

3. The panty garment of claim 1, wherein the two leg openings comprise cut-outs at predetermined locations in the tubular blanks.

4. The panty garment of claim 1, further comprising a means for making various sizes of the panty garment on the same circular knitting machine.

5. The panty garment of claim 4, wherein the means for making various sizes of the panty garment comprises increasing or decreasing the stitch loop length in the tubular blanks.

6. The panty garment of claim 1, wherein the crotch comprises a Y-seam sewn about a lengthwise slit of the bottom of the front panel for a predetermined length.

7. The panty garment of claim 1, wherein the crotch comprises a stitch pattern different from a stitch pattern of the remainder of the panty garment.

8. The panty garment of claim 1, further comprising:

yam knit into wales and courses;

a knit direction from the bottom to the top;

the two leg openings comprising cut-outs across wales; and run prevention stitches knit in predetermined courses downstream from the cut-outs, wherein runs are prevented downstream from the cut-outs in a front portion of the garment.

9. The panty garment of claim 8, wherein the run prevention stitches comprise float stitches.

10. The panty garment of claim 8, wherein the run prevention stitches comprise tuck stitches.

11. The panty garment of claim 1, wherein the two leg openings comprise cut-outs along an angle substantially parallel to knitted wales, wherein runs are prevented downstream from the cut-outs.

12. A three-piece panty garment, comprising:

a front panel formed from a first tubular blank, a first back panel formed from a second tubular blank, and a second back panel formed from a third tubular blank, each tubular blank knit on a small-circumference circular knitting machine knitting cylinder having a circumference, and each panel having a top and a bottom;

a crotch portion integrally knit with the front panel;

a waistband at the top of the front and back panels;

two leg openings;

a lengthwise front seam joining each side of the front panel and one of the back panels and extending between the waistband and a topmost point of one of the leg openings;

a lengthwise rear seam joining the two back panels and extending between the waistband and the crotch portion; and a rear crotch seam joining the bottoms of the two back panels with the bottom of the front panel and extending transversely between the leg openings, wherein the garment comprises an unstretched girth substantially three times the circumference of the knitting cylinder.

13. A method of making a panty garment, comprising:

knitting at least three tubular blanks on a small-circumference circular knitting machine;

making cut-outs for leg openings at predetermined locations in the tubular blanks;

slitting each of the tubular blanks lengthwise to form a front panel from a first tubular blank, a first back panel from a second tubular blank, and a second back panel from a third tubular blank, each panel having a top and a bottom;

sewing a lengthwise front seam extending between a waistband and one of the leg openings to join each side of the front panel and one of the back panels;

sewing a lengthwise rear seam extending between the waistband and a crotch portion to join the two back panels; and sewing a rear crotch seam extending transversely between the leg openings to join the bottoms of the two back panels with the bottom of the front panel.

14. The method of claim 13, the circular knitting machine comprising a knitting cylinder having a circumference, and wherein the garment comprises an unstretched girth substantially three times the circumference of the knitting cylinder.

15. The method of claim 13, further comprising making various sizes of the panty garment on the same circular knitting machine by increasing or decreasing the stitch loop length in the tubular blanks.

16. The method of claim 13, further comprising slitting the bottom of the front panel lengthwise for a predetermined length to provide a Y-shaped crotch and sewing the slit along the crotch.

17. The method of claim 13, further comprising:

knitting the garment in a direction from the bottom to the top;

making leg opening cut-outs across wales; and knitting run prevention stitches in predetermined courses downstream from the cut-outs.

18. The method of claim 17, wherein knitting run prevention stitches further comprises knitting float stitches or tuck stitches.

19. The method of claim 13, further comprising making leg opening cut-outs along an angle substantially parallel to knitted wales, wherein runs are prevented downstream from the cut-outs.

* * * * *